United States Patent [19]

Siller

[11] Patent Number: 4,753,118

[45] Date of Patent: Jun. 28, 1988

[54] DRIVING ARRANGEMENT, ESPECIALLY FOR A LIQUID METERING PUMP

[75] Inventor: Rudi Siller, Abstadt, Fed. Rep. of Germany

[73] Assignee: Cillichemie, Ernst Vogelmann GmbH & Co., Heilbronn, Fed. Rep. of Germany

[21] Appl. No.: 920,271

[22] Filed: Oct. 17, 1986

[30] Foreign Application Priority Data

Oct. 19, 1985 [DE] Fed. Rep. of Germany ..... 3537297

[51] Int. Cl.[4] ..... F16H 21/16

[52] U.S. Cl. ..... 74/25; 74/592

[58] Field of Search ..... 74/55, 592, 589, 590, 74/49, 25; 92/94

[56] References Cited

U.S. PATENT DOCUMENTS

| | | | |
|---|---|---|---|
| 1,697,786 | 1/1929 | Sholberg | 292/130 R |
| 1,775,653 | 9/1930 | Mundt | 74/592 |
| 2,287,627 | 1/1940 | Malsbary et al. | 74/592 |
| 3,067,624 | 12/1962 | Norton et al. | 74/55 |

FOREIGN PATENT DOCUMENTS

| | | | |
|---|---|---|---|
| 3338112 | 9/1985 | Fed. Rep. of Germany . | |
| 0771337 | 10/1934 | France | 74/55 |
| 1241097 | 8/1960 | France | 74/49 |
| 0292182 | 10/1953 | Switzerland | 74/49 |
| 0405078 | 7/1966 | Switzerland . | |

*Primary Examiner*—Leslie A. Braun
*Assistant Examiner*—Scott Anchell
*Attorney, Agent, or Firm*—Erwin S. Teltscher

[57] ABSTRACT

A driving arrangement for a pump, especially a liquid metering pump, includes a pump tappet mounted on a support for displacement in and opposite to a predetermined direction during a pumping and a return stroke thereof, respectively. A restoring spring member urges the pump tappet opposite to the predetermined direction. There is further provided a mechanical energy storage device which includes a storage tappet mounted on the support spaced from the pump tappet for displacement in and opposite to the predetermined direction, and an elastically yieldable storage member urging the storage tappet in the predetermined direction. The tappets are alternatingly displaced against the forces exerted thereon by the respective spring and storage members by a motor-driven eccentric member interposed between the tappets and having an outer surface which acts on the pump tappet at least during a predetermined part of each of the strokes to displace the pump tappet against the force of the restoring spring member in the predetermined direction, and on the storage tappet to displace the same opposite to the predetermined direction with attendant storage of mechanical energy in the compressible storage member for transmission of such stored mechanical energy to the pump tappet during subsequent movement of the storage tappet in the predetermined direction.

10 Claims, 2 Drawing Sheets

DRIVING ARRANGEMENT, ESPECIALLY FOR A LIQUID METERING PUMP

BACKGROUND OF THE INVENTION

The present invention relates to driving arrangements in general, and more particularly to a driving arrangement for a pump, especially for a liquid metering pump.

There are already known various constructions of driving arrangements of the type here under consideration, among them such which include a motor-driven pump tappet which is displaceable in and opposite to a predetermined direction during a pumping and a return stroke, respectively. Known liquid metering pumps driven by an electric motor powered drive of this type typically include a step-down transmission which drives an eccentric or cam disc which, in turn, acts on the pump tappet. The return stroke is then performed under the influence of a restoring spring. There may further be provided a stroke limiter which is positionally adjustable from the exterior of the driving arrangement. This principle is usable with piston pumps as well as diaphragm pumps. In these known constructions, the output power of the motor is used only for the displacement of the pump tappet in the predetermined or pumping direction. During the return or suction stroke, the motor operates in an idle mode. During the course of the pumping stroke, the motor causes the force which is exerted on the pump tappet in the predetermined direction to gradually and steadily increase from a relatively low level up to a maximum or peak level achieved when the eccentric member has displaced the pump tappet to the largest possible extent during the pumping stroke. Therefore, the driving motor must be dimensioned so as to have an output power sufficient to sustain the peak load. However, in the known liquid metering pumps, the satisfaction of this requirement means that, during most of the stroke cycle, and especially during the return stroke, the output power of the motor is unused so that, on the average, it is necessary to overdimension the motor.

SUMMARY OF THE INVENTION

Accordingly, it is a general object of the present invention to avoid the disadvantages of the prior art.

More particularly, it is an object of the present invention to provide a driving arrangement for a pump, which does not possess the drawbacks of the known arrangements of this type.

Still another object of the present invention is to devise a driving arrangement of the type here under consideration which renders it possible to provide a smaller dimensioning of the driving motor while still satisfying the peak load requirements.

It is yet another object of the present invention to design the above arrangement in such a manner as to keep energy losses to a minimum.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a driving arrangement for a pump, especially a liquid metering pump, this driving arrangement comprising a support; a pump tappet mounted on the support for displacement in and opposite to a predetermined direction during a pumping and a return stroke thereof, respectively; a restoring spring member urging the pump tappet opposite to the predetermined direction; means for storing mechanical energy, including a storage tappet mounted on the support spaced from the pump tappet for displacement in and opposite to the predetermined direction, and an elastically yieldable storage member urging the storage tappet in the predetermined direction; and means for alternatingly displacing the tappets against the forces exerted thereon by the respective spring and storage members, including a motor-driven eccentric member interposed between the tappets and having an outer surface which acts on the pump tappet at least during a predetermined part of each of the strokes to displace the pump tappet against the force of the restoring spring member in the predetermined direction, and on the storage tappet to displace the same opposite to the predetermined direction with attendant storage of mechanical energy in the compressible storage member for transmission of such stored mechanical energy to the pump tappet during subsequent movement of the storage tappet in the predetermined direction.

The present invention as described so far is based on the idea of storing motor-originating energy during the return stroke of the pump tappet in the form of a mechanical potential energy, and of using the stored potential energy during the pumping stroke for the enhancement of the motor output power. Accordingly, there is provided, in accordance with the present invention, an arrangement for storing mechanical energy, this storing arrangement being charged by the motor-driven eccentric or cam disc or a similar eccentric member during the return stroke of the pump tappet and which applies to the pump tappet a force effective in opposition to a counterforce exerted on the pump tappet by the restoring spring.

According to an advantageous concept of the present invention, the storing means further includes a coupling member arranged between the pump tappet and the storage tappet and bridging the eccentric member. Advantageously, the tappets have respective end faces which face one another and act on the eccentric member, and the coupling member holds the end faces of the tappets apart by a distance which is slightly, such as by 0.5 to 0.1 mm, larger than the diameter of the eccentric member. It is particularly advantageous when the coupling member includes at least one cantilevered arm which is rigidly connected with the storage tappet and has an end surface region, and when the pump tappet has a rear shoulder which cooperates with the end surface region of the cantilevered arm. An especially advantageous construction is obtained when the coupling member further includes an additional cantilevered arm arranged at an opposite side of the eccentric member from the one cantilevered arm, and when the cantilevered arms bridge the eccentric member in a cage-like manner.

It is further proposed in accordance with the present invention to further provide a limiting abutment extending into the path of displacement of the pump tappet and operative for preventing further displacement of the pump tappet opposite to the predetermined direction upon abutment of the pump tappet thereagainst. Advantageously, the storage member includes at least one storage spring, especially a prestressed compression spring. The storage spring may be a helical spring, torsion spring, leaf spring, spiral spring or a Belleville spring packet. However, the storage member may as well include at least one component of an elastomeric material or a gas pressure accumulator.

According to another advantageous concept of the present invention, the eccentric member includes an eccentric shaft, and at least one ball bearing mounted on the eccentric shaft and including an outer race having an outer surface Then, it is advantageous when the pump and storage tappets have respective end faces which face one another and engage the outer surface of the outer race of the one ball bearing under the force exerted thereon by the spring member and the storage member, respectively. However, it is also contemplated by the present invention to provide an additional ball bearing similar to and separate from the one ball bearing and mounted on the eccentric shaft at an axial spacing from the one ball bearing. In this case, the pump and storage tappets have respective end faces which face toward each other and each of which engages the outer surface of the outer race of a different one of the ball bearings under the force exerted thereon by the spring member and the storage member, respectively. There may further be provided friction-reducing means such as sliding surfaces or rollers on at least some of those surfaces of the eccentric member and of each of the tappets which come into contact with one another.

An optimum accommodation of the storage arrangement to the pump load is achieved when the force applied by the storage arrangement to the pump tappet amounts to about 25 to 50% of the peak loading, and when the force to be expended by the motor-driven eccentric member on charging the storage arrangement amounts to about 50 to 75% at the most of the peak loading encountered at the pump tappet. A driving arrangement with these parameters is capable of achieving, for a given dimensioning or output power of the motor, an increase of about 30% in the pump loading. Conversely, a correspondingly smaller and thus less expensive motor than heretofore can be used for the same pump loading as in the prior-art arrangements of this type.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
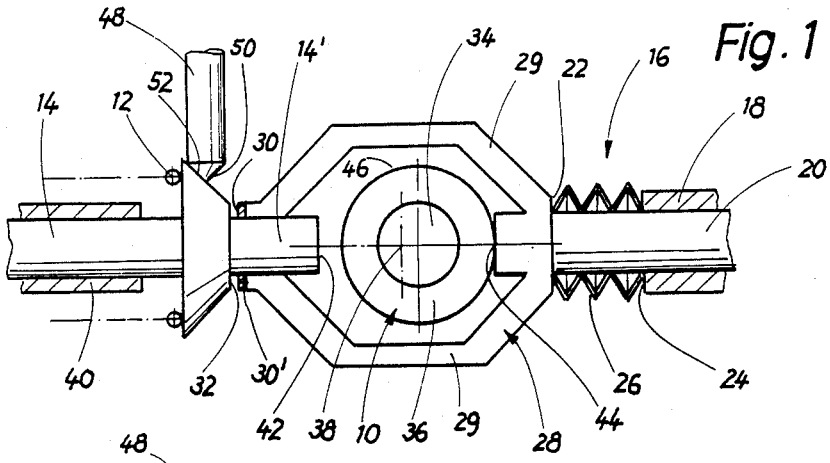
FIGS. 1 to 3 are corresponding top plan views of a driving arrangement according to the present invention during different phases of operation of the same.
Figure 2:
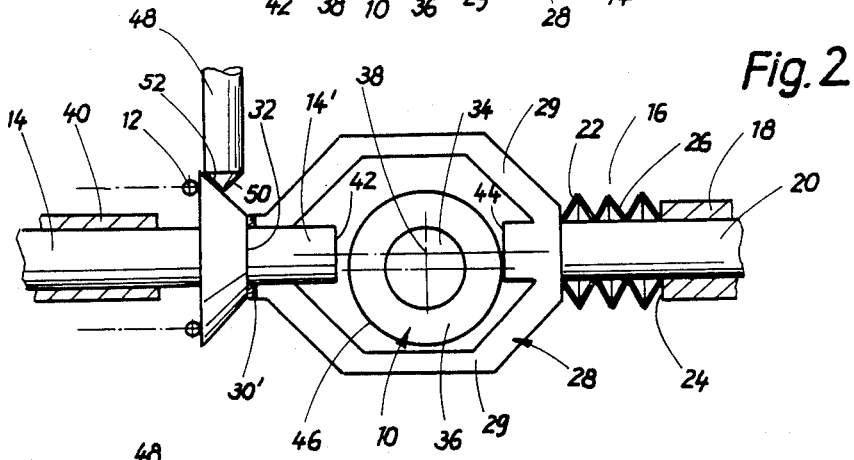
Figure 3:
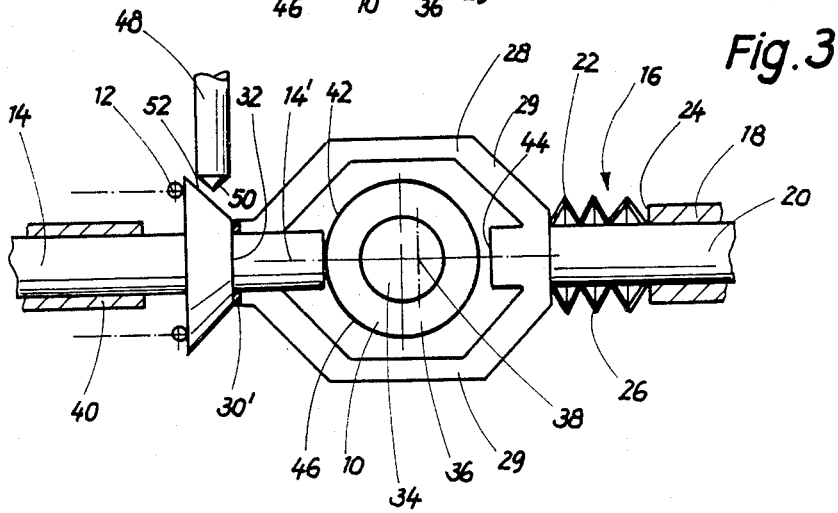

Referring now to the drawing in detail, and first to FIGS. 1 to 3 thereof, it may be seen that a driving arrangement depicted therein includes as its main components a motor-driven eccentric disc 10, a pump tappet 14 which is displaceable by the eccentric disc 10 against the force of a restoring spring 12, which is prestressed and an arrangement 16 for storing mechanical energy. The mechanical energy storing arrangement 16 includes a storage tappet 20 which is displaceably guided in a guide 18 that is stationary with respect to a housing of the driving arrangement, and a set of Belleville springs 26 which are arranged on the storage tappet 20 and are clamped under prestressed conditions between a shoulder 22 of the storage tappet 20 and a shoulder 24 which is stationary with respect to the driving arrangement housing, for instance, as shown, by being provided on the stationary guide 18. A coupling member 28 is formed on the storage tappet 20 and includes respective cantilevered arms 29 which embrace the eccentric disc 10 with a lateral distance therefrom in a cage-like manner. The coupling member 28 further includes an end face region 30 which is capable of abutting against and engaging an annular shoulder 32 of the pump tappet 14. The end face region 30 of the coupling member 28 is constituted by an annular abutment shoe 30' which is guided on a trailing end 14' of the pump tappet 14.

The eccentric disc 10, which consists of an inner disc 34 and a track ring or race 36 which is supported on the inner disc 34 for rotation relative thereto in a low-friction manner, such as by means of non-illustrated bearing balls, is mounted on an output shaft of a non-illustrated electric driving or stepping motor for rotation about an eccentric axis 38. This eccentric axis 38 is stationarily arranged between the two tappet guides 18 and 40. The eccentric disc 10 is situated between respective end faces 42 and 44 of the two tappets 14 and 20 which face each other and has an outer circumferential surface 46 which alternatingly abuts these two end faces 42 and 44, depending on its angular position about the eccentric axis 38. The coupling member 28 of the storage tappet 20, when in abutment with the annular shoulder 32 of the pump tappet 14, defines a distance between the end faces 42 and 44 which is slightly larger, such as by 0.05 to 0.1 millimeters, than the outer diameter of the eccentric disc 10 but is considerably smaller than the tappet stroke. In order to provide a better elucidation of the situation, the distances in question are not drawn to scale; rather, they are somewhat exaggerated. For the adjustment of the pump stroke, a pin-shaped limiting abutment 48 is mounted for displacement axially thereof on the housing of the driving arrangement. The limiting abutment 48 has a conical tip 50, and the pump tappet 14 has an inclined abutment surface 52 which is urged by the restoring spring 12 toward abutment with the conical tip 50 of the limiting abutment 48.

In an initial position of the above-discussed components, which is illustrated in FIG. 1 of the drawing, the eccentric disc 10 is displaced to the maximum possible extent toward the storage tappet 20 and contacts a central region of the end face 44 of the coupling member 28 of the storage tappet 20. The set or packet of Belleville springs 26 is compressed between the two shoulders 22 and 24 to its minimum axial extent and thus possesses the highest level of potential energy encountered during a cycle of operation of the driving arrangement. On the other side of the driving arrangement, the abutment surface 52 of the pump tappet 14 abuts the limiting abutment or pin 48. Both the eccentric disc 10 and the coupling member 20 are lifted off the respective associated end or shoulder surfaces 32 and 42 of the pump tappet 14.

Now, when the eccentric disc 10 is turned about the eccentric axis 38 in the clockwise direction into the position illustrated in FIG. 2, the storage tappet 20 is displaced, with attendant expansion of the packet of Belleville springs 26, in the direction toward the pump tappet 14, until the abutment shoe 30' of the coupling member 28 abuts the annular shoulder 32 of the pump tappet 14 and lifts the pump tappet 14 under the influence of the force of the packet of Belleville springs 26 from the tip 50 of the limiting abutment or pin 48, against the force exerted on the pump tappet 14 by the restoring spring 12. During the further joint displacement of the storage and pump tappets 20 and 14 in the leftward direction as considered in the drawing, the counterforce of the restoring spring 12 to be overcome gradually increases until it becomes equal to the force exerted by the packet of Belleville springs 26. From this moment on, the eccentric disc 10 starts to lift off and move away from the end face 44 of the storage tappet 20 and eventually comes into contact with the rear or trailing end face 42 of the pump tappet 14, so that the missing force is now transmitted from the motor to the pump tappet 14. However, even during the last phase of the leftward movement of the pump tappet 14 toward and into the position illustrated in FIG. 3 of the drawing, the packet of Belleville springs 26 contributes, due to its prestressing, to a certain extent to the overcoming of the counterforce of the restoring spring 12. Advantageously, the spring characteristics and prestressing are chosen in such a manner that, at the time of reaching the maximum loading in the position of FIG. 3, about 25 to 50% of the force acting on the pump tappet 14 in the leftward direction is transmitted or exerted by the storage arrangement 16.

During the further turning of the eccentric disc 10 in the clockwise direction out of the position depicted in FIG. 3, the pump tappet 14 is gradually returned under the influence of the counterforce exerted thereon by the restoring spring 12, until it abuts against the limiting abutment 48. From the moment of force equilibrium, but in any event at the latest after the abutment of the pump tappet 14 against the limiting abutment 48, the eccentric disc 10 starts to lift off and move away from the end face 42 of the pump tappet 14 and eventually comes into contact with and starts acting on the end face 44 of the storage tappet 20. During this phase of operation of the driving arrangement, the packet of Belleville springs 26 is compressed by the power or force supplied by the motor and thus is brought to a higher potential energy level. Herein, the spring characteristics are advantageously selected in such a manner that the peak force to be exerted by the eccentric disc 10 on the storage tappet 20 to bring the same into its position illustrated in FIG. 1 of the drawing corresponds to about 50 to 75% of the peak load which is encountered at the pump tappet 14.

Figure 4:
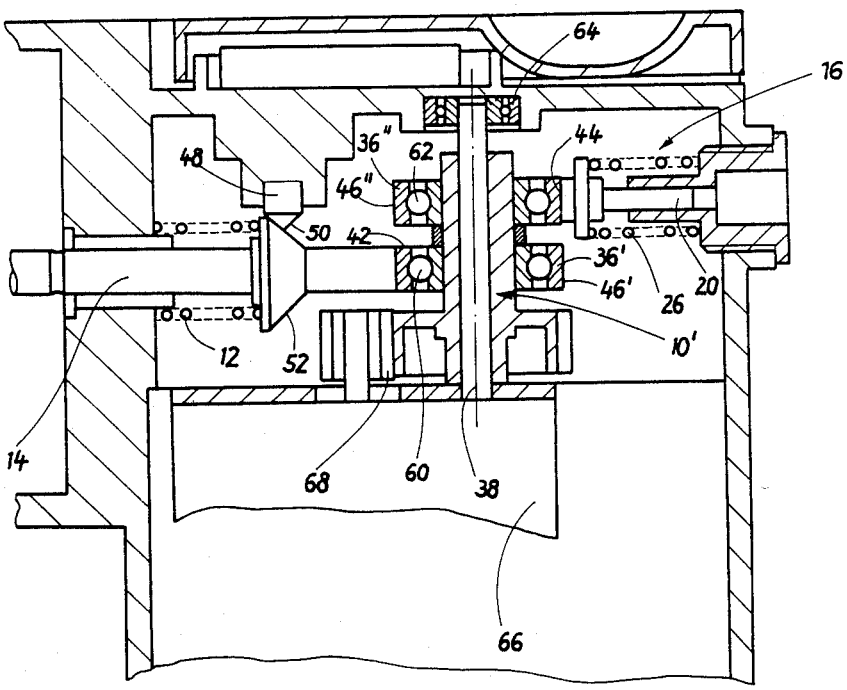
FIG. 4 is a vertical sectional view of a modified driving arrangement according to the present invention.

FIG. 4 of the drawing shows a modified construction of the driving arrangement of the present invention which employs the same principles as discussed above and is similar to the above-discussed construction in so many respects that the same reference numerals, possibly supplemented with single and double primes, are being used to indicate the same or corresponding parts. The construction depicted in FIG. 4 includes an eccentric shaft 10' which is mounted on an upper anti-friction bearing 64, which is shown to be constructed as a ball bearing, and on a non-illustrated lower bearing, both of which are mounted stationarily with respect to the driving arrangement housing, for rotation about its eccentric axis 38, and is driven in rotation about such axis 38 by a motor 66 and a reduction transmission 68. As shown, two ball bearings 60 and 62 which are separate from each other are arranged on the eccentric shaft 10' at an axial distance from one another. The pump tappet 14 is subjected to the influence of the restoring spring 12, which is constructed as a helical spring, so that its end face 42 abuts against the outer circumferential surface 46' of the outer ring or race 36' of the ball bearing 60, whereas the storage tappet 20 is subjected to the influence of the spring 26 which serves as a potential energy storage arrangement and which, in this instance, is constructed as a helical spring, so that its end face 44 abuts against the outer circumferential surface 46'' of the outer ring or race 36'' of the ball bearing 62. Consequently, the respective outer ring 36' or 36'' can roll during the rotation of the eccentric shaft 10' on the associated end face 42 or 44 of the associated tappet 14 or 20, without encountering any transverse friction. In this modified construction, the above-discussed coupling member 28 is dispensed with since it is not needed.

In principle, it would also be possible, while using only one ball bearing on the eccentric shaft 10', to let the two tappets 14 and 20 act from diametrically opposite sides on the outer ring or race 36 of this single bearing, without employing any coupling member 28. However, under these circumstances, there would have to be accepted sliding friction losses between the two tappets 14 and 20 and the outer race 36. On the other hand, in this particular modified construction, application to the eccentric shaft 10' of a torque which is to be borne by the bearings, such as 64, of the eccentric shaft 10' would be avoided. In addition thereto, one of the ball bearings 60 and 62 would be dispensed with, with an attendant cost reduction, so that there would be obtained overall a very economical construction of the driving arrangement. Moreover, the sliding friction effect or losses at the region of the outer race 36 can be reduced by resorting to the use of suitable friction-reducing measures, such as by using lubricants, a sliding coating, or rollers.

While the present invention has been described and illustrated herein as embodied in specific constructions of a pump driving arrangement, it is not limited to the details of this particular construction, since various modifications and structural changes are possible and contemplated by the present invention. Thus, the scope of the present invention will be determined exclusively by the appended claims.

What is claimed is:

1. A driving arrangement for a pump, especially a liquid metering pump, comprising a support, a pump tappet mounted on said support for displacement in and opposite to a predetermined direction during a pumping and a return stroke thereof, respectively;

a restoring spring member urging said pump tappet opposite to said predetermined direction;

means for storing mechanical energy, including a storage tappet mounted on said support spaced from said pump tappet for displacement in an opposite to said predetermined direction, said pump and storage tappets having respective end faces which face toward each other; and an elastically yieldable storage member urging said storage tappet in said predetermined direction; and means for alternatingly displacing said tappets against the forces exerted thereon by the respective spring and storage members, including a motor-driven eccentric member including an eccentric shaft and two ball bearings mounted on said eccentric shaft, said ball bearings similar to and separate from each other and mounted on said eccentric shaft at an axial spaced distance from each other, each of said ball bearings including an outer race, one of said outer races defining a first outer surface and other of said outer races defining a second outer surface, and said motor-driven eccentric member being interposed between said tappets, whereby said first outer surface is engaged with said pump tappet end face at least during a predetermined part of said pumping stroke to displace said pump tappet against the force of said restoring spring member in said predetermined direction, and said second outer surface is engaged with said storage tappet end face to displace the same opposite to said predetermined direction with attendant storage of mechanical energy in said yieldable storage member for transmission of such stored mechanical energy to said pump tappet during subsequent movement of said storage tappet in said predetermined direction.

2. The driving arrangement as defined in claim 1, and further comprising a limiting abutment extending into the path of displacement of said pump tappet and operative for preventing further displacement of said pump tappet opposite to said predetermined direction upon abutment of said pump tappet thereagainst.

3. The driving arrangement as defined in claim 1, wherein said storage member includes at least one storage spring.

4. The driving arrangement as defined in claim 3, wherein said storage spring is a compression spring.

5. The driving arrangement as defined in claim 3, wherein said storage spring is prestressed.

6. The driving arrangement as defined in claim 3, wherein said storage spring is a helical spring.

7. The driving arrangement as defined in claim 3, wherein said storage spring is a Bellville spring packet.

8. The driving arrangement as defined in claim 1, wherein said storage member includes at least one component of an elastomeric material.

9. The driving arrangement as defined in claim 1, and further comprising friction-reducing means on at least some of those surfaces of said eccentric member and of each of said tappets which come into contact with one another.

10. The driving arrangement as defined in claim 9, wherein said friction-reducing means includes a sliding coating.

* * * * *